US007717737B2

(12) United States Patent
Bossi

(10) Patent No.: US 7,717,737 B2
(45) Date of Patent: May 18, 2010

(54) DIRECT BATTERY CONFIGURATION

(75) Inventor: Fabio Bossi, Trieste (IT)

(73) Assignee: Honeywell International Inc., Morristown, NJ (US)

( * ) Notice: Subject to any disclaimer, the term of this patent is extended or adjusted under 35 U.S.C. 154(b) by 97 days.

(21) Appl. No.: 12/142,288

(22) Filed: Jun. 19, 2008

(65) Prior Publication Data

US 2009/0318035 A1 Dec. 24, 2009

(51) Int. Cl.
*H01R 3/00* (2006.01)

(52) U.S. Cl. ..... 439/500

(58) Field of Classification Search ..... 439/500; 429/100, 99, 96

See application file for complete search history.

(56) References Cited

U.S. PATENT DOCUMENTS 4,221,454 A 9/1980 Wong ..... 339/176 R
5,607,795 A 3/1997 Saida ..... 429/100
6,641,432 B1 * 11/2003 Ouyoung ..... 439/500
7,255,959 B2 8/2007 Chan ..... 429/100
7,589,494 B2 * 9/2009 Yang ..... 320/107

OTHER PUBLICATIONS

Hand Held Dictation Unit, "Spring pos and negative Of Both Battery", "Spring solder on the PCB", Product on sale, in public use before Feb. 1, 2007, (2 views) 2 pgs.

Smoke Detector Unit, Product on sale, in public use before Feb. 1, 2007, 1 pg.

* cited by examiner

*Primary Examiner*—Phuong K Dinh
(74) *Attorney, Agent, or Firm*—Husch Blackwell Sanders Welsh & Katz

(57) ABSTRACT

A battery contact apparatus has one fixed contact formed on a printed circuit board and a displaced movable contact. At least one battery is insertable into the space between the contacts. The movable contact biases the battery toward the fixed contact to provide a complete electrical circuit.

14 Claims, 4 Drawing Sheets

DOUBLE BATTERIES

MULTIPLE BATTERIES

SINGLE BATTERY

DIRECT BATTERY CONFIGURATION

FIELD

The invention pertains to battery powered products. More particularly, the invention pertains to low cost and robust electromechanical structures to connect batteries to electrical components.

BACKGROUND

A variety of cost sensitive products incorporate one or more batteries. These include toys, thermostats, various types of audio or video players, calculators, or various types of sensors.

In known products contact pairs can be affixed by soldering. At times double spring contacts have been used to assure contact with the battery(s). Flashlights have long used a compressible spring as one contact to a string of batteries. The other contact is usually on a base of the electric light.

There is a continuing need to reduce product cost and complexity. It would be desirable to be able to do so while at the same time providing ease of insertion and reliable contact to the battery(s) required by the product.

DETAILED DESCRIPTION

Figure 1:
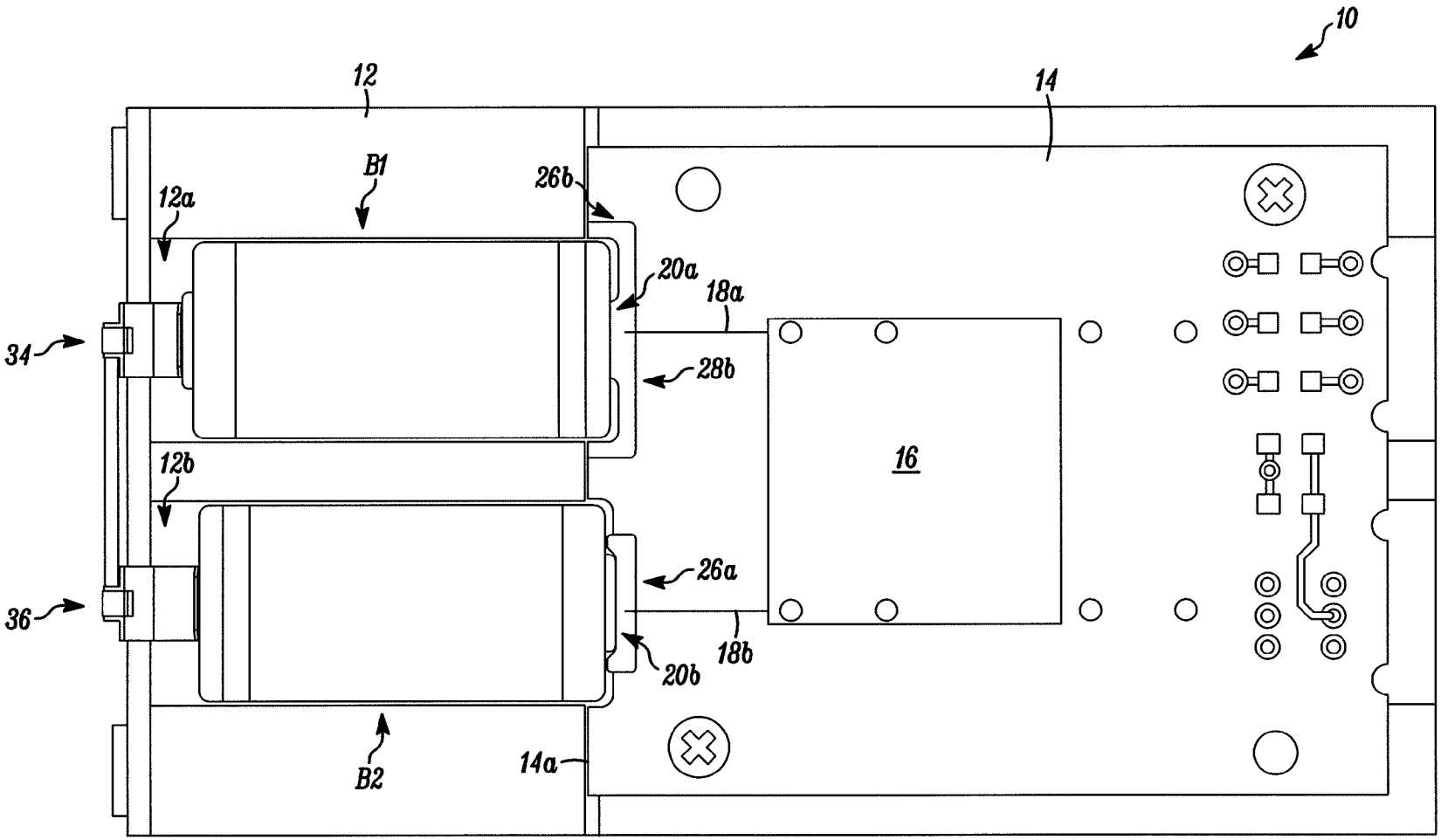
FIG. 1 is a top plan view of an embodiment of the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Embodiments of the invention provide reliable and low cost battery connections by providing one contact on a non-movable printed circuit board of the respect product and a second, spring biased contact. As a result, bill of material and assembly costs can be reduced.

Figure 2:
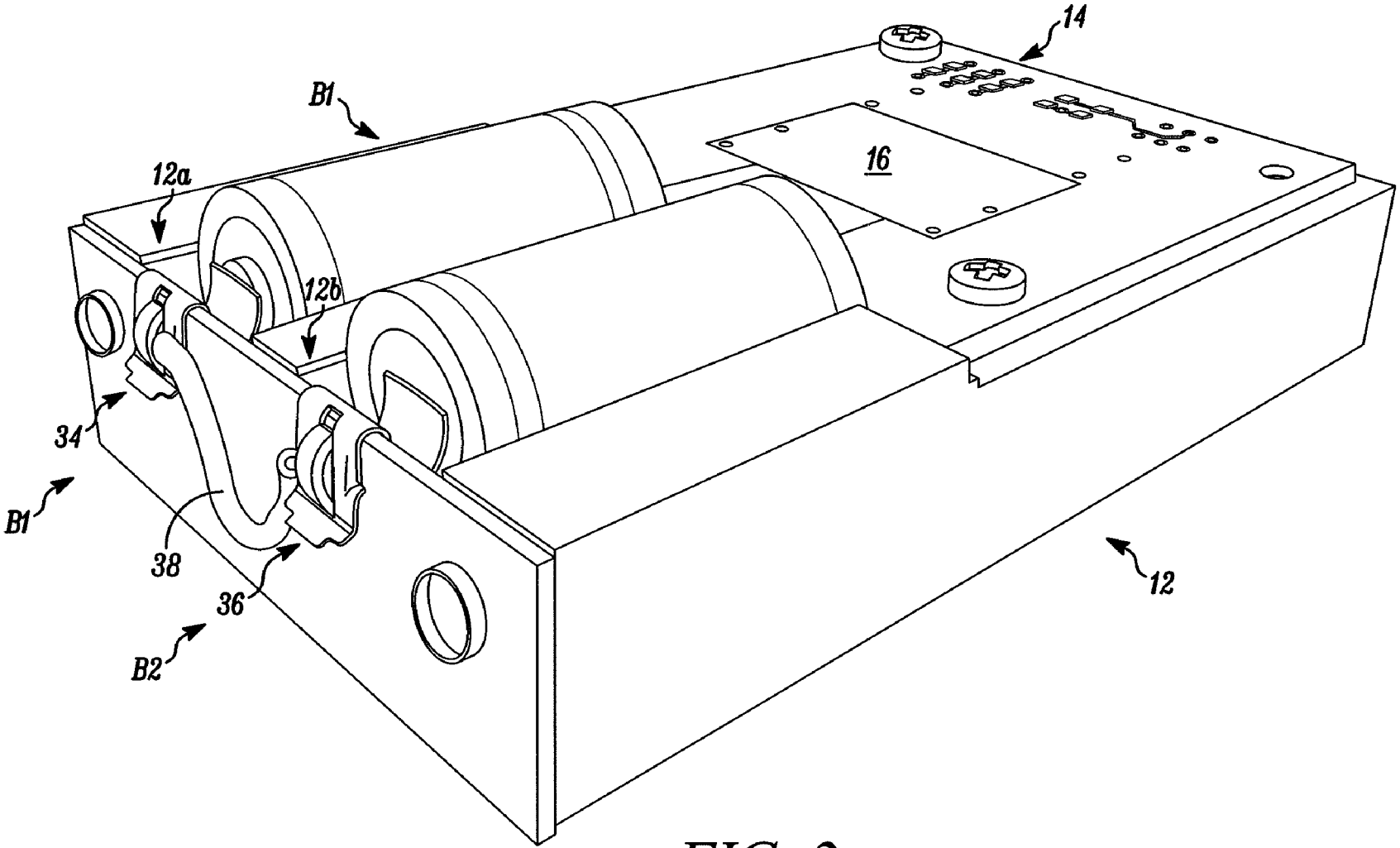
FIG. 2 is an end, perspective-type view of the embodiment of FIG. 1.
Figure 3:
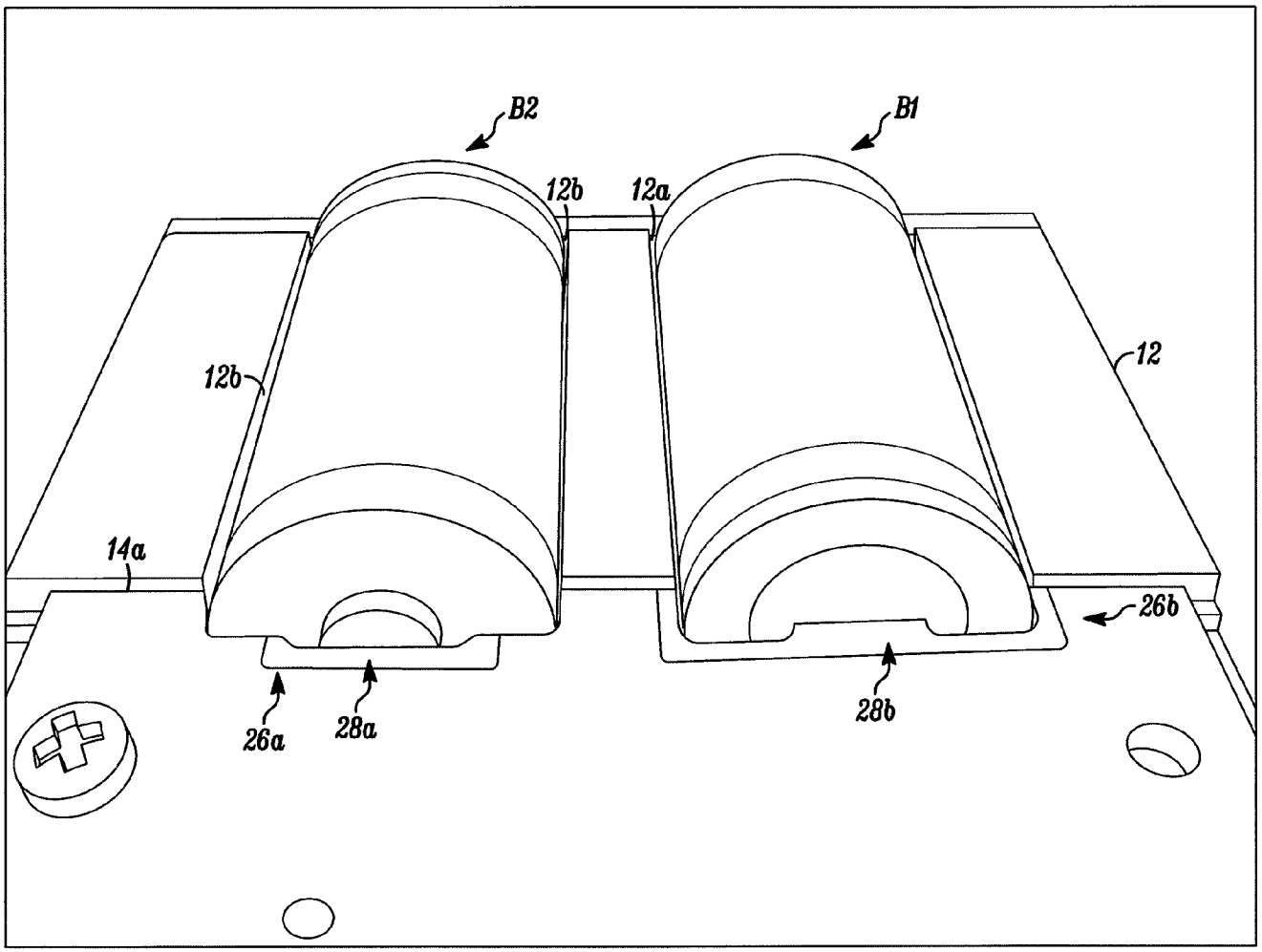
FIG. 3 is a partial, enlarged view looking toward batteries of the embodiment of FIG. 1.

FIGS. 1-3 illustrate different view of a two battery product 10 which embodies the invention. Product 10 includes a housing 12 which carries a printed circuit board 14.

Printed circuit board 14 carries electronic, or electrical circuitry generally indicated at 16. Printed conductors 18*a, b* couple circuitry 16 to battery contacts 20*a*, 20*b* printed on the board 14. The contacts 20*a, b* are formed at an edge 14*a* of the board 14.

As best seen in FIG. 3, contacts 20*a,b* include an elongated body portion 26*a,b* and a shaped battery terminal engaging central region 28*a,b*. The regions 28*a, b* preferably extend at ninety degrees along the edge 14*a*, perpendicular to the plane of the board 14, so as to provide a contact surface which abuts an adjacent battery terminal.

Housing 12, defines two battery receiving slots 12*a*, 12*b*. Slots 12*a,b* each slidably and removably receive a respective battery B1, B2 which energize product 10. In the exemplary product 10, a negative terminal of battery B1 abuts and forms an electrical path with contact portion 28*b*. A positive terminal of battery B2 abuts and forms an electrical path with contact portion 28*a*.

Spring biased contacts 34, 36 carried by housing 12 slidably engage a positive terminal of battery B1 and a negative terminal of battery B2, see FIG. 2. Contacts 34, 36 are electrically shorted together by conductor 38. It will be understood that conductor 38 could be formed on a printed circuit board. Other implementations come within the spirit and scope of the invention.

In view of the above, each of batteries B1, B2 is biased toward edge 14*a* by the respective spring contact 34, 36 to provide a completed electrical circuit relative to circuitry 16. As illustrated, each contact portion 28*a,b* is rigidly supported by insulating printed circuit board 14 while the respective battery B1, B2 is biased theretoward by the respective, movable, spring contact 34, 36.

Figure 4A:
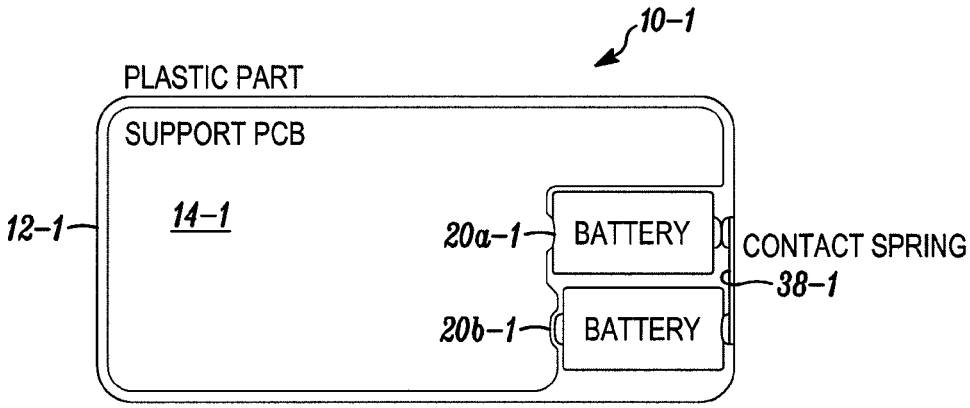
FIGS. 4A, B, C illustrate alternate product configurations.
Figure 4B:
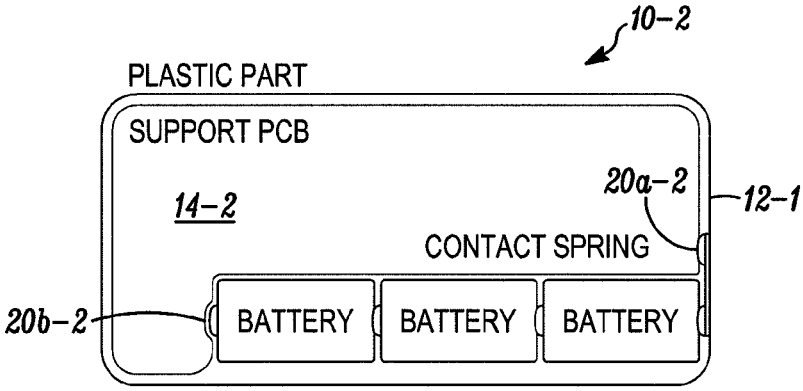
Figure 4C:
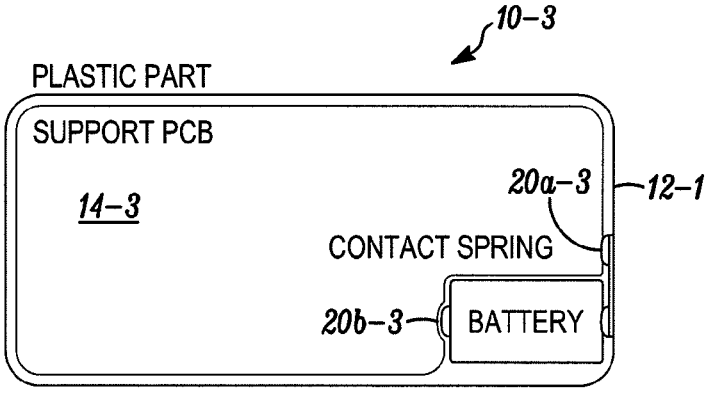

FIGS. 4A, 4B and 4C illustrated additional product configurations indicated by 10-1, -2, -3. Product 10-1 incorporates two batteries coupled together in series as in FIG. 1-3. FIG. 4B illustrates in product 10-2 a three battery configuration. FIG. 4C illustrates a single battery configuration.

All of the products 10-1, -2 and -3 can use a common housing 12-1 with a respectively configured printed circuit board 14-1, -2, -3 which supports a two battery, a three battery or a single battery product and connects to the associated battery(s). In each instance, the respective printed circuit board 14-*i* carries positive and negative terminal contacts such as 20*a-i*, 20*b-i* configured in combination with one or more batteries.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A battery structure comprising:

a housing;

at least one spring biased, deflectable battery contact carried by the housing;

an elongated battery receiving depression formed in the housing and having first and second ends with one end located adjacent to the deflectable contact; and an insulated planar member carried by the housing with a portion thereof positioned adjacent to the other end of the battery receiving region with a second battery contact substantially non-movably carried thereon and where the second contact overlays an adjacent portion of the member and both the underlying section of the planar member and the overlying section of the second contact extend toward the spring biased contact.

2. A structure as in claim 1 where the second contact has integrally formed first and second parts with one part extending parallel to the planar member, the parts being substantially perpendicular to one another.

3. A structure as in claim 2 where the first and second parts are bonded to first and second surfaces of the planar member.

4. A structure as in claim 3 where a central axis of the battery receiving depression extends parallel to a surface of the planar member.

5. A structure as in claim 4 which includes:

a third, spring biased, deflectable battery contact, carried by the housing adjacent to and electrically coupled to the one spring loaded battery contact.

6. A structure as in claim 5 which includes:

a fourth battery contact substantially non-movably carried on the planar member displaced from the second battery contact.

7. A structure as in claim 6 where the battery receiving depression has a width parameter which exceeds a distance between the second and fourth contacts.

8. A structure as in claim 7 where the second and fourth contacts are coupled to an electrical load.

9. A structure as in claim 8 which includes first and second batteries located in the battery receiving depression and releasably coupled to the contacts.

10. A battery powered electrical unit comprising:

a housing;

an insulative substrate carried by the housing;

an electrical load carried by the housing and at least in part, by the substrate;

at least one, non-movable, battery contact formed on the substrate; and at least one deflectable battery contact spaced from the at least one non-movable contact and the substrate defines, at least in part, a battery receiving slot.

11. A unit as in claim 10 with the contacts spaced apart a predetermined distance corresponding to a length parameter of a battery.

12. A unit as in claim 10 with the contacts spaced apart a predetermined distance corresponding to a length parameter of a stacked plurality of batteries.

13. A unit as in claim 12 where the length parameter corresponds to at least two batteries arranged end-to-end.

14. A unit as in claim 10 where the electrical load comprises one of a smoke detector, a gas detector, a thermal detector, a fire detector, or a thermostat.

* * * * *